United States Patent [19]

Rawlings et al.

[11] 4,121,690

[45] Oct. 24, 1978

[54] ROOFER'S STAGING

[76] Inventors: Eugene Rawlings, 1319 Lincoln Ave., Prospect Park, Pa. 19076; Frederick J. Olsson, 212 Spruce Tree Rd., Radnor, Pa. 19087

[21] Appl. No.: 829,660

[22] Filed: Sep. 1, 1977

[51] Int. Cl.[2] ..... E04G 5/08; E04G 3/12

[52] U.S. Cl. ..... 182/45; 182/223

[58] Field of Search ..... 182/45, 222, 223, 82; 248/235

[56] References Cited

U.S. PATENT DOCUMENTS

| | | | |
|---|---|---|---|
| 812,301 | 2/1906 | Schwedt | 182/223 |
| 1,312,994 | 8/1919 | Leonard | 182/223 |
| 1,886,921 | 4/1932 | Tobin | 182/45 |
| 4,020,921 | 5/1977 | Rawlings | 182/45 |

*Primary Examiner*—Reinaldo P. Machado

[57] ABSTRACT

Roofer's staging having a pair of light weight, metal platforms telescoped together and longitudinally slidable between closed and open positions. In the closed position, the platforms form a short pack (about 4 feet in length) for a roofer to carry up the ladder and deposit on the roof. On the roof the pack can be expanded so that the plaforms extend in-line to form a staging (about 8 feet in length). A major feature is that the roofer has the option of expanding either to the right or to the left.

13 Claims, 9 Drawing Figures

ROOFER'S STAGING

This invention relates to roofer's equipment and in particular relates to roofer's staging having improvements over the staging shown in U.S. Pat. No. 4,020,921.

The above mentioned patent discloses a roofer's staging having a pair of platforms telescoped together and longitudinally slidable between closed and open positions. In the closed position, the platforms form a short pack which a roofer can easily carry up a ladder to a roof. When on the roof, the platforms can be expanded or moved to a fully or partially open position wherein one platform is the extension of the other and forms a staging. The working length of the staging is equivalent to that of the conventional 10 foot wooden plank and jacks.

The present invention is concerned with improving the versatility of such staging particularly with respect to the manner in which the staging can be expanded when on the roof.

In roofing work, conditions often-times occur which makes it highly desirable that the staging of the kind in question be as easily and safely expandable in the right hand direction and in the left hand direction.

Thus, one of the principal objects of the invention is to provide a staging of the kind mentioned which is constructed so that the roofer has the option of nailing down either one of the platforms and then expanding the stage by sliding the other to a partially or to a fully open position.

In the preferred form, the invention contemplates a pair of platforms telescoped together with fixed supports on the outer ends and with an intermediate support slidably mounted on the telescoped area and serving as a common mount for the platforms. Either platform can be secured to the roof by nailing its end support and the intermediate support to the roof and then sliding the other platform to the desired open or partially open position wherein it can be secured by nailing down its end support.

The dual sliding feature is important particularly from the standpoint of the safety and reduction in work time. The ability to expand in either direction reduces the necessity for the roofer to over-extend himself or take substantial risks in getting set up to continue the shingling operation.

In connection with the relative sliding between the itermediate support and the platforms, the invention contemplates means to minimize or eliminate cocking of the intermediate support. The achievement of the latter obviates binding which leads to uneven or jerky motion and the development of counter forces which may cause the roofer to loose his balance. Smooth, even operation contributes to safety on the roof.

With respect to nailing down the platforms, the invention contemplates keyhole slots which are arranged in a pattern and oriented on the supports so as to enhance the likelihood of the nails being driven directly into a joist rather than just thru the roof sheathing.

The invention will be explained in connection with the following drawings wherein.

Figures 1, 2, 3, 4, 5:
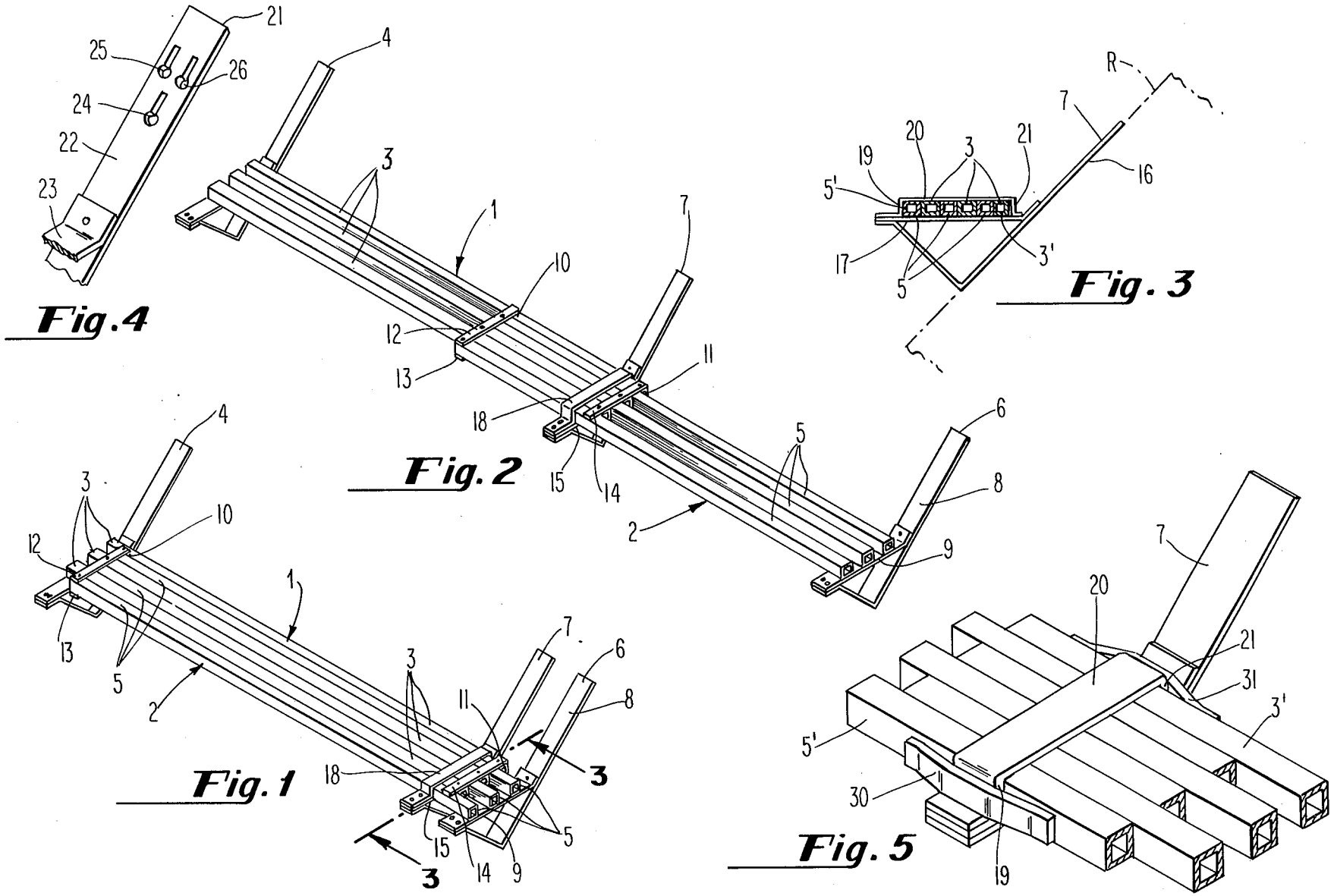
FIG. 1 is a perspective view of a staging of the invention with the platforms in closed position or arranged in a pack.
FIG. 2 is a perspective view of the staging of FIG. 1 with the platforms in a partially open or expanded condition.
FIG. 3 is a side elevational view taken along the lines 3—3 of FIG. 1.
FIG. 4 is a fragmentary perspective view of the roof section of a support employed in the stagings of FIGS. 1 and 2 provided with safety keyhole slots.
FIG. 5 is a fragmentary view of the intermediate support of the staging of FIG. 1 provided with stablizing outriggers.

In FIG. 1, the roofer's staging has a pair of platforms 1 and 2. The platform 1 includes the beams 3 and end support 4 and the platform 2 includes the beams 5 and end support 6. An intermediate support 7 is slidably mounted on the beams and serves as a common support for the platforms.

The beams 3 and 5 are in the form of square tubes of equal length. The set of beams 3 are spaced apart and extend parallel and coextensive with each other. The set of beams 5 are likewise spaced apart and extend parallel and coextensive with one another. The tops of the respective beams form the platforms 1 and 2 for the roofer. The sets of beams are nested or telescoped together in a snug sliding fit.

The end supports 4, 6 and 7 are identical in construction. Thus, referring to end support 6 the same comprises a roof section 8 and a platform section 9. The roof section of the end support is adapted to mount the staging on a roof, for example, see FIG. 3 where the intermediate support 7 is shown down on the roof R.

The beams 3 are fixedly connected to the platform section of end support 4 and the beams 5 are fixedly connected to the platform section of the end support 6. The respective platform sections firmly support the beams. In addition to being connected to the platform sections the opposite ends of the beams are provided with means to maintain the telescoped condition. Referring to the beams 5, the ends 10 are fixed to a pair of straps 12 and 13 which fixedly connect the ends 10 together. The straps 12 and 13 make a sliding engagement with the beams 3.

The top strap 12 prevents the beam 5 from moving down past the beams 3 and thus maintains the telescoped condition. The bottom strap 13 prevents the beam 5 from moving up past the beam 3 and thus maintains the telescoped condition.

The ends 11 of the beams 3 are provided with the straps 14 and 15. These straps function in the same way as the straps 12 and 13.

As telescoped together, the respective beams and their supports are longitudinally slidable as between a closed position as noted in FIG. 1 and a fully open or partially open position as in FIG. 2.

The closed position is defined by the engagement of the bottom strap 13 with the end support 4 and the engagement of the bottom strap 15 with the end support 6. In the closed position, the beams and supports form a short (about 4 feet) unitary pack which a roofer can easily carry up a ladder and either deposit at the eave or carry to some other desired area.

The fully open position is defined by the straps 12/13 and straps 14/15 respectively engaging the opposite sides of the intermediate support 7. In the fully open or partially open positions the beams are longitudinally spaced and in line whereby one platform is the extension of the other and an expanded staging is formed. As expanded the staging is of greater length than the pack.

As shown in FIG. 3, the intermediate support 7 has a roof section 16 and a platform section 17. A keeper 18 is connected to the intermediate support. The side 19 of the keeper is fixed to the platform section and extends adjacent the outboard beam 5'.

The top 20 of the keeper extends over the tops of the beams 3 and 5. The side 21 extends adjacent the outboard beam 3' and is fixed to the platform section. The sides 19 and 21 and top 20 of the keeper and the platform section 17 make a sliding engagement with the beams 3 and 5.

The keeper and the platform section hold the intermediate support and the beams together and provide for the intermediate support and the beams to be relatively longitudinally slidable. This is important in achieving the feature of the staging being extendable in either direction with equal facility. The manner in which the dual extension is carried out will be explained in connection with FIGS. 1 and 2.

Referring to FIG. 1, assume that it is desired to expand to the right. This is done by fixing the platform 1 and moving the platform 2. First, the platforms are set up in closed position. the intermediate support is positioned against the straps 14 and 15. The end support 4 and the intermediate support 7 are nailed to the roof. The support 6 and beams 5 are not nailed and so are free to move. Thus the platform 2 or beams 5 and end support 6 can be shifted to the right to a partially open or to a fully open position. The platform 2 is then secured by nailing down the end support 6.

When it is desired to expand or extend in the opposite direction the intermediate support 7 is shifted down to the left adjacent the support 4. Then the intermediate support 7 and the end support 6 are nailed down to the roof. This leaves the platform 1 with its beams 3 and support 4 free on the roof. The platform can then be moved to the left to the partially or fully open position and nailed secure.

In the partially open condition the intermediate support 7 is centrally positioned to serve as a common support for the beams 3 and 5. The intermediate support is automatically centrally positioned when the platforms are in the fully open position.

For purpose of nailing the supports, there is provided a unique arrangement of keyhole slots, the primary purpose of which is to enhance the safety factor of the staging and to improve the manner in which the support can be freed from the nails.

Referring to FIG. 4, the support has the same construction as supports 5, 6 and 7 and includes the roof section 22 and the platform section 23. The roof section 22 has three keyhole slots 24, 25 and 26. Each slot extends axially along the roof section and is oriented so that its enlarged section is directed toward the platform section. The slot 24 is disposed along the center of the roof section and the slots 25 and 26 are disposed equidistant on opposite sides of the center. In the preferred arrangement the center slot 24 is closest to the platform section.

The components of the staging of FIGS. 1 and 2 are dimensioned so that in the fully closed position the distance between the intermediate support and the opposite end support is 48 inches. This distance corresponds to the center distance between 4 roof joists which are normally on 16 inches centers. In the fully open position the distance between the center and the end supports 4 and 6 is 96 inches.

From the above it will be apparent that in the closed position nails thru the center keyhole slots of the intermediate support and an end support will go directly into the joists. If the joist happens to be somewhat off center, the same will be picked up by nails driven thru the slots 25 and 26. Likewise, when the stage is fully extended a nail thru the center keyhole slot of each end support will be driven into a joist.

Thus, the likelihood of a nail being driven directly into a joist rather than just the sheathing is greatly increased. This is very important from the standpoint of safety.

The orientation of the keyhole slot with the head toward the platfrom section is important for ease of removal of the support from the roof. For such purposes the lower end of the roof section is tapped by a hammer to move the same upwardly (toward the ridge and this brings the nailheads directly into the enlarged sections. The support then can be simply pulled up and away. There is no necessity for moving the support sideways to the left or to the right.

Oftentimes, the staging is opened and closed on the roof where the footing conditions are far less secure than on the ground and where the roofer may have to reach out to move the intermediate support while at an angle or in an off-center position. It is important, therefore, that the intermediate support be capable of being moved without cocking or in a smooth, continuous fashion so as to avoid erratic or jerky motion which could develop sudden counterforces tending to throw the roofer off balance.

The preferred manner of minimizing cocking is to longitudinally extend the keeper to form outriggers which contact the beams at outboard points so as to achieve a stabalizing or anti-cocking effect. FIG 5 is a fragmentary view showing how the outrigger concept is applied to the keeper 18 of FIG. 1.

The side 19 of the keeper is provided with arm 30 which extends in the longitudinaly direction outwardly from opposite sides of the intermediate support and at outboard points and makes a sliding contact with the beam 5'. The side 21 of the keeper is provided with an arm 31 which also extends in a longitudinal direction outwardly from opposite sides of the intermediate support 7 and at outboard points makes a sliding contact with the beam 3'.

The components are constructed and dimensioned so that in the assembled condition the contact between the beams and sides 19 and 21 and the arms 30 and 31 is firm enough so that as to avoid cocking of the intermediate support when the same is moved. A typical example of such contact is illustrated as follows. If the staging is set up with one of the fixed end supports on the ground and then oriented vertically the contact should be such that the intermediate suppot will remain fixed on the beams unless a slight force is applied to move same.

The usual manner of moving the intermediate support along the beams is to grasp the front leg of the roof section then either push or pull the support to the desired position.

In FIG. 5 it will be observed that both the keeper sides 19 and 21 make a sliding contact with the respective beams 5' and 3'. It will be understood that the contact between the sides 19 and 20 and the beams can be eliminated so that contact is made only thru the medium of the arms.

Figure 6:
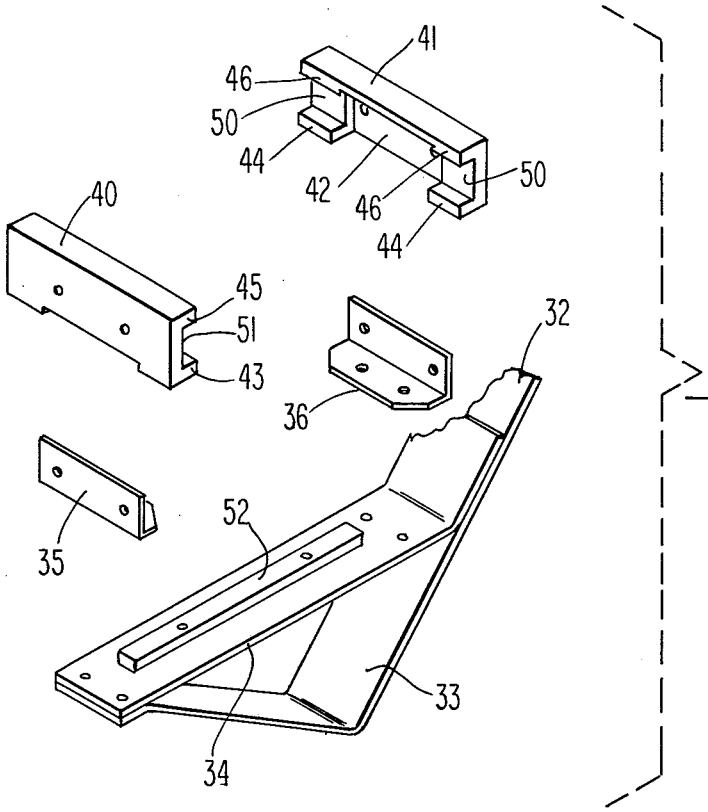
FIG. 6 is an exploded view of an intermediate support which is provided with another embodiment of stablizing outriggers.
Figure 7:
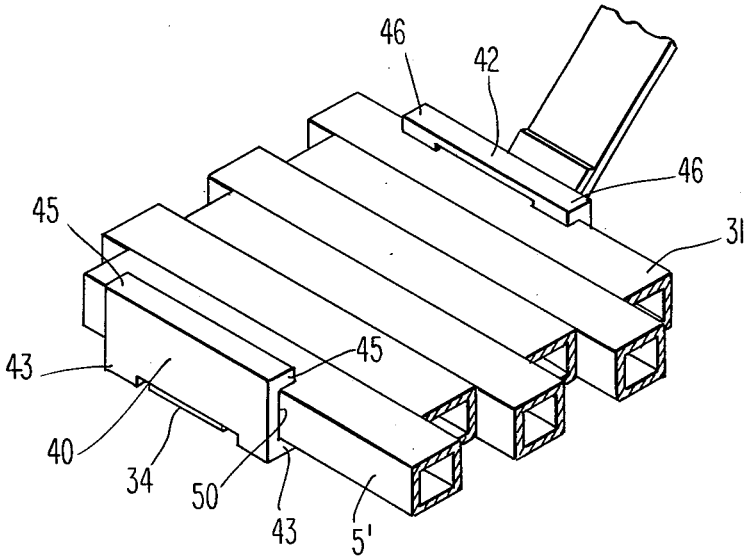
FIG. 7 is a perspective view of the components of FIG. 6 assembled together.

FIGS. 6 and 7 illustrate an embodiment of the outrigger concept wherein the top of the keeper makes a sliding contact with only the outboard beams.

The intermediate support 32 shown in FIG. 6 is similar to the supports heretofore described having a roof section 33 and a platform section 34.

A pair of brackets 35 and 36 are adapted to be secured to the platform section 34 as by the riveting. The brackets hold the outrigger arms 40 and 41. The brackets fit into sockets such as socket in arm 41. The arms are secured to the brackets by riveting. When the components are assembled (see FIG. 7) the lower flanges 43 and 44 respectively contact the outboard beams 3' and 5' and the upper flanges 45 and 46 contact the tops of the outboard beams 3' and 5'.

The outboard side of the outboard beam 3' makes a sliding fit with the flats 50. The outboard side of the outboard beam 5' makes a sliding fit with the flats 51.

As will be apparent, the arms 40 and 41 both extend in a longitudinal direction outwardly from opposite sides of the intermediate support. Thus the respective contacts between the beams and the flanges and flats are outboard of the support.

In the structure of FIGS. 6 and 7 the bottom flanges 43 and 44 are a part of the platform section and support the beams just above the platform section proper. It is preferred, therefore, to provide means on the platform section to make a sliding fit with the other beams and assist in supporting the same. In FIG. 5 this is shown in a form of a strip 52 fixed to the platform section.

In the embodiment in FIG. 7, with the tops of the keeper comprising upper flanges 45 and 46, it is desirable that both upper and lower straps 12/13 and both upper and lower straps 14/15 be employed at the ends of the beams.

Figure 8:
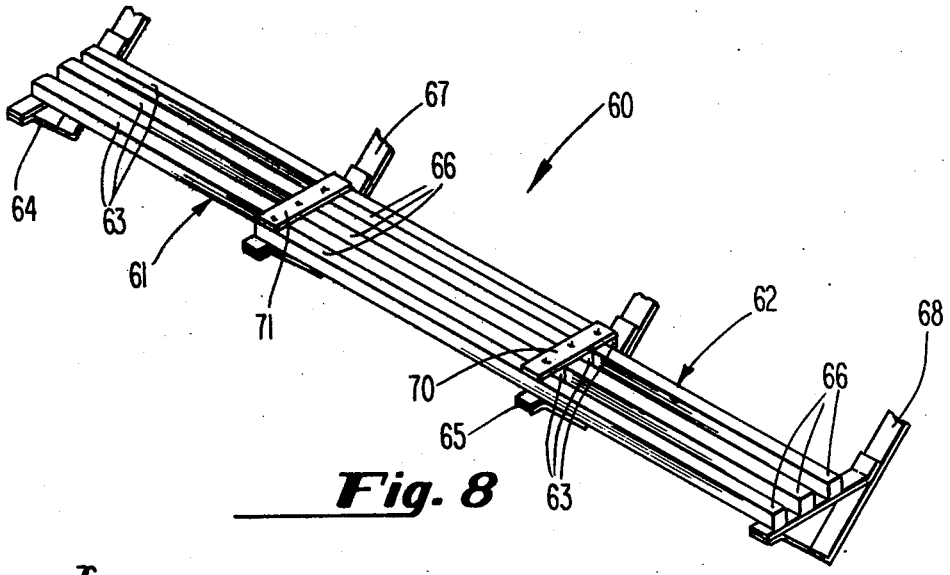
FIG. 8 is a perspective view of another staging of the invention shown in a partially open position.

FIG. 8 illustrates another form of staging embodying the concept of extension from either side.

The staging 60 comprises a platform 61 and a platform 62. The platform 61 is comprised of the beams 63 together with the end supports 64 and 65. The platform 62 is comprised of beams 66 and end supports 67 and 68. In each platform, the respective beams extend parallel and co-extensive with one another.

The beams 63 and 66 are telescoped together, similarly as the beams of FIG. 1. The support 65 of platform 61 is disposed between the supports 67 and 68 while the support 67 of platform 62 is disposed between the supports 64 and 65.

The beams 63 are fixedly connected to the end supports 64 and 65. The beams are also interconnected by strap 70. The strap 70 makes a sliding engagement with the beams 66. The beams 66 are fixed to the end supports 67 and 68 are are interconnected by the strap 71 which makes a sliding fit with the beams 63.

The above structure provides for the platforms 61 and 62 to be longitudinaly slidable relative to one another between closed and open positions. As will be evident, the platforms in FIG. 8 are in a partially open position. In the closed position, the support 67 is adjacent or abutting the support 64 and the support 68 is adjacent or butting the support 65. The foregoing condition of the suports defines the closed position.

In the open position, the supports 63 and 67 are adjacent or abutting one another and this defines the fully open position.

It will be seen therefore, that if the supports 64 and 65 of the platform 61 are fixed to the roof the free platform 62 can be moved as between the closed and open positions. Likewise, if the supports 67 and 68 of platform 62 are fixed to the roof the free platform 61 can be moved as between the closed and open positions.

The keyhole pattern described in connection with FIG. 4 is also applied to the supports in FIG. 8. The foregoing may be accomplished, for example, by making the supports 64 and 68 approximately 3 inches in width and the supports 65 and 67 aproximately 1 inch in width with the beams being of lengths so that the distance between the facing edges of the supports 64 and 65 is 45 inches and the distance between the facing edges of the supports 67 and 68 is also 45 inches.

Also, with respect to the pattern of the keyhold slots, the center slot and the two outboard slots may be axially spaced a greater distance apart than as used for the supports of FIG. 1 to avoid weakening the roof section of the support.

Figure 9:
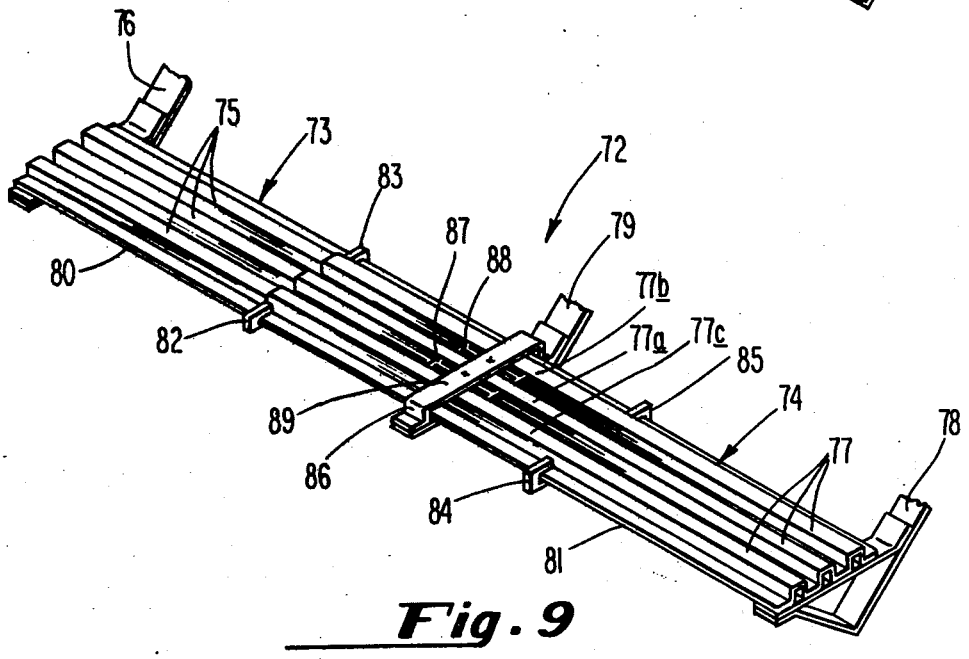
FIG. 9 is a perspective view of another staging of the invention shown in a partially open position.

The various features of the invention can be employed where the beams are formed as by the corrugations in metal sheets. An example of this is shown in FIG. 9.

The staging 72 includes the platforms 73 and 74. The platform 73 includes the beams 75 and end support 76 while the platform 74 includes the beams 77 and the end support 78.

The beams 75 and 77 are formed as by rolling corrugations in the metal sheets 80 and 81 and are overlapped as to be telescoped together.

The intermediate support 79 is common to both the platforms 73 and 74, and makes a sliding connection with the beams 75 and 77.

The supports 76, 78 and 79 are of the same construction as the supports described heretofore. The platform section of the end support 76 and the beams 75 are fixedly connected together while the platform section of the end support 78 and the beams 77 are also fixedly connected together.

Means are provided on the free ends of each beam to maintain the telescoped condition and in the embodiment illustrated, this includes the pairs of C-shaped retainers 82/83 and 84/85.

The retainers 82 and 83 are secured to the top side of sheet 81 or beams 77 and extend down and underneath and make a sliding engagement with sheet 80. This prevents the sheets or beams from moving apart. The retainers 84 and 85 are each secured to the underside of the sheet 80 or beams 75 and extend up and over to make a sliding engagement with sheet 81 or beams 77. This prevents the sheets or beams from moving apart.

As will be apparent, the above structure provides for the platforms 73 and 74 to be moved as between closed and open positions. The closed position is defined by the engagement of the retainers 82/83 with end support 76 and the engagement of retainers 84/85 with support 78. The fully open position is defined by the retainers 82/83 and 84/85 engaging opposite sides of the intermediate support 79.

The intermediate support 79 has a keeper 86 which is similar to the keeper 18 of FIG. 1. The keeper 86 may be provided with outrigger means similarly as described in FIG. 5. Preferably, however, the outriggers take the form as shown in FIG. 9.

A pair of arms 87 and 88 are connected to the top 89 and disposed in spaces on opposite sides of the center beam 77 *a* of the beams 77 and make a sliding engagement therewith. The arms may also engage the other beams 77 *b* and 77 *c*. The arms extend in the longitudinal direction outboard of the intermediate support 79 and function to prevent cocking of the same. In lieu of the above, the arms may be connected to the platform section of the intermediate support 79 and extend into the spaces on the opposite sides of one of the beams 75.

While it is not shown, it will be understood that either of the metal sheets 80 or 81 can be provided with a number of apertures axially spaced along the sheets. The apertures are for use in providing drain holes in case the staging is left on a roof during a storm and also as an outlet for dirt or shingle granules that may collect on the sheets.

The embodiments described in connection with FIGS. 8 and 9 are useful in special applications particularly where an additional margin of safety is desired.

The staging of FIG. 8 is especially suitable for heavy duty applications. A job may demand that all of the shingles for a given side of a roof be brought up and stored, for example, where free ground space is required. In these cases the stage can be partially expanded so that the distance between the center keyholes of supports 64 and 67 is approximately 32 inches. In this way each of the supports will be nailed directly into a joist. Also the span between the beams is decreased. The secure nailing and decreased span engances the load carrying capacity Thus, several of the stagings can be strung along the eave of a roof and serve to support all of the bundles of shingles. The same type of stage expansion may be employed by masons to support heavy loads such as bricks, blocks or stones.

The staging of FIG. 9 is useful for mechanics who employ a large number of hand tools or other small items and need a large space for storage. Another application for the staging of FIG. 9 is where pedestrians will be constantly walking below the eave area and maximum insurance against falling tools or materials is desired.

In connection with supporting heavier loads it will be appreciated that the intermediate support is particularly useful. For example, the staging can be expanded to the partially open position and then the intermediate support adjusted to the center of the stage. Thus the span of the beams is reduced and the beams are supported at equidistant points. Also, where the stage is not fully expanded the intermediate support can be adjusted toward one end and the heavier load, say several bundles of shingles, can be supported at that end.

Furthermore, roof joists or rafters are not always on the conventional 16 inches or 24 inches centers. In such cases, the staging can be partially expanded so that the opposite end supports can be nailed into joists and then the intermediate support adjusted to a position so that it can also be nailed into a joist.

Before closing it is pointed out that the various components mentioned above are perferably made from aluminum or magnesium alloys and either welded or riveted together.

We claim:

1. A roofer's staging comprising:

a first platform including a plurality of first beams spaced apart and extending parallel to and co-extensive with one another, the beams constituting a platform for a roofer;

a first support adjacent one end of said first beams and having a roof section and a platform section, the roof section being adapted to engage a roof for mounting the staging thereon and the platform section being fixedly connected to and supporting said first beams;

a second platform including a plurality of second beams spaced apart and extending parallel and co-extensive with one another, the beams constituting a platform for a roofer;

a second support adjacent one end of the second beams and having a roof section and a platform section, the roof section being adapted to engage a roof for mounting the staging thereon and the platform section being fixedly connected to and supporting said second beams;

said first and second beams being telescoped together and the respective beams and their supports being longitudinally slidable relative to one another as between a closed position and an open position, in the closed position the respective beams forming a unitary pack for a roofer to carry up a ladder and deposit on a roof, the length of the pack being substantially less than the length of the staging and in the open position the beams being longitudinally spaced whereby one platform is an extension of the other and an expanded staging is formed;

first means disposed adjacent the opposite end of said first beams and operatively, slidably connected between the first and second beams and maintaining the beams in telescoped condition;

second means disposed adjacent the opposite end of said second beams and operatively, slidably connected between the first and second beams and maintaining the beams in telescoped condition;

an intermediate support disposed between said first and second means, the support having a roof section and a platform section, the roof section being adapted to engage a roof for mounting the staging thereon and the platform section supporting and having a sliding engagement with said first and second beams;

the intermediate support also having keeper means fixed to the support and having a sliding engagement with said first and second beams; and the keeper means and the platform section holding the intermediate support and beams together and providing for the intermediate support and the beams to be relatively longitudinally slidable whereby when either one of said first or second supports and its beams are fixed to the roof and the other support and its beams are not fixed to the roof, said other support and beams can be moved as between said closed and open positions.

2. The staging of claim 1 wherein said keeper means includes a strap extending across the tops of the first and second beams and having a sliding engagement therewith.

3. The staging of claim 1 further including outrigger means connected to said intermediate support and extending in said longitudinal direction outwardly from opposite sides of said intermediate support and having a sliding contact with at least one of said beams to prevent the support from cocking during said longitudinal relative motion.

4. The staging of claim 1 further including outrigger means connected to said intermediate support and disposed on opposite sides of the first and second beams and extending outwardly from opposite sides of the intermediate support and respectively having a sliding contact with at least one of the beams to prevent the intermediate support from cocking during said longitudinal relative motion.

5. The staging of claim 1 wherein said first means comprises a pair of first straps disposed adjacent the opposite end of the first beams and respectively extending across the tops and bottoms of the telescoped first and second beams and having a sliding engagement with at least some of the second beams and connected to the first beams whereby the first beams are fixedly connected together; and wherein said second means comprises a pair of second straps disposed adjacent the opposite end of the second beams and respectively extending across the tops and bottoms of the telescoped first and second beams and having a sliding engagement with at least some of the first beams and connected to the second beams whereby the second beams are fixedly connected together.

6. A roofer's staging comprising:

a first platform including a plurality of first beams spaced apart and extending parallel to and co-extensive with one another, the beams constituting a platform for a roofer;

a first support adjacent one end of said first beams and having a roof section and a platform section, the roof section being adapted to engage a roof for mounting the staging thereon and the platform section being fixedly connected to and supporting said first beams;

a second platform including a plurality of second beams spaced apart and extending parallel and co-extensive with one another, the beams constituting a platform for a roofer;

a second support adjacent one end of the second beams and having a roof section and a platform section, the roof section being adpated to engage a roof for mounting the staging thereon and the platform section being fixedly connected to and supporting said second beams;

said first and second beams being telescoped together and the respective beams and their supports being longitudinally slidable relative to one another as between a closed position and an open position, in the closed position the respective beams forming a unitary pack for a roofer to carry up a ladder and deposit on a roof, the length of the pack being substantially less than the length of the staging and in the open position the beams being longitudinally spaced whereby one platform is an extension of the other and an expanded staging is formed;

a pair of first straps disposed adjacent the opposite end of the first beams and respectively extending across the tops and bottoms of the telescoped first and second beams and having a sliding engagement with at least some of the second beams and connected to the first beams whereby the first beams are fixedly connected together;

a pair of second straps disposed adjacent the opposite end of the second beams and respectively extending across the tops and bottoms of the telescoped first and second beams and having a sliding engagement with at least some of the first beams and connected to the second beams whereby the second beams are fixedly connected together;

an intermediate support disposed between said first and second pairs of straps, the support having a roof section and a platform section, the roof section being adapted to engage a roof for mounting the staging thereon and the platform section supporting and having a sliding engagement with said first and second beams the intermediate support having keeper means fixed to the support and having a sliding engagement with said first and second beams;

the intermediate support also having a pair of outriggers connected to the platform section of said intermediate support respectively on opposite sides of the first and second beams and each extending in said longitudinal direction outwardly from opposite sides of the intermediate support and respectively having a sliding contact with said beams to prevent the intermediate support from cocking during said longitudinal relative motion; and the keeper means and the platform section holding the intermediate support and beams together and providing for the intermediate support and the beams to be relatively longitudinally slidable whereby when either one of said first or second support and its beams are fixed to the roof and the other support and its beams are not fixed to the roof, the other first or second support and beams can be moved as between the open and closed positions.

7. A roofer's staging comprising:

a first platform including a plurality of first beams spaced apart and extending parallel to and co-extensive with one another, the beams constituting a platform for a roofer;

a first support adjacent one end of said first beams and having a roof section and a platform section, the roof section being adapted to engage a roof for mounting the staging thereon and the platform section being fixedly connected to and supporting said first beams;

a second platform including a plurality of second beams spaced apart and extending parallel and co-extensive with one another the beams constituting a platform for a roofer;

a second support adjacent one end of the second beams and having a roof section and a platform section, the roof section being adapted to engage a roof for mounting the staging thereon and the platform section being fixedly connected to and supporting said second beams;

said first and second beams being telescoped together and the respective beams and their supports being longitudinally slidable relative to one another as between a closed position and an open position, in the closed position the respective beams forming a unitary pack for a roofer to carry up a ladder and deposit on a roof, the length of the pack being substantially less than the length of the staging in the open position and in the open position the beams being longitudinally spaced whereby one platform is an extension of the other and an expanded staging is formed;

first means disposed adjacent the opposite end of said first beams and operatively, slidably connected between the first and second beams and maintaining the beams in telescoped condition;

second means disposed adjacent the opposite end of said second beams and operatively, slidably connected between the first and second beams and maintaining the beams in telescoped condition;

said connections and sliding engagements of said first and second means providing that when either one of said first or second supports and its beams are fixed to the roof and the other support and its beams are not fixed to the roof, the other support and beams can be moved as between the closed and open positions; and intermediate support means connected adjacent said first and second means in a position intermediate said first and second supports and supporting the first and second beams on the roof when the same are in the open position.

8. A roofer's staging comprising:

a first platform including a plurality of first beams spaced apart and extending parallel to and co-extensive with one another, the beams constituting a platform for a roofer;

a first support adjacent one end of said first beams and having a roof section and a platform section, the roof section being adapted to engage a roof for mounting the staging thereon and the platform section being fixedly connected to and supporting said first beams;

a second support adjacent the opposite end of said first beams and having a roof section and a platform section, the roof section being adapted to engage a roof for mounting the staging thereon and the platform section being fixedly connected to and supporting said first beams;

a second platform including a plurality of second beams spaced apart and extending parallel to and co-extensive with one another the beams constituting a second platform for a roofer and the first and second beams being telescoped together;

a third support adjacent one end of the second beams and having a roof section and a platform section, the roof section being adapted to engage a roof for mounting the staging thereon and the platform section engaging and supporting said second beams;

a fourth support adjacent the opposite end of the second beams and having a roof section and a platform section, the roof section being adapted to engage a roof for mounting the staging thereon and the platform section engaging and supporting said second beams;

said first and second beams being telescoped together wherein said third support is disposed between said first and second supports and said second support is disposed between said third and fourth supports and the respective beams and their supports being longitudinally slidable relative to one another as between a closed position and an open position, in the closed position the respective beams forming a unitary pack for a roofer to carry up a ladder and deposit on a roof, the length of the pack being substantially less than the length of the staging in the open position and in the open position the beams being longitudinally spaced whereby one platform is an extension of the other and an expanded staging is formed; and said sliding, telescoped structure providing that when either one of the first or second beams and supports are fixed to the roof and the other beams and its supports are not fixed to the roof, the other beams and supports can be moved as between said closed and open positions.

9. A roofer's staging comprising:

a first sheet having corrugations forming a plurality of first beams spaced apart and extending parallel to and co-extensive with one another, the beams constituting a platform for a roofer;

a first support adjacent one end of said first beams and having a roof section and a platform section, the roof section being adapted to engage a roof for mounting the staging thereon and the platform section being fixedly connected to and supporting said first beams;

a second sheet having corrugations forming a plurality of second beams spaced apart and extending parallel to and co-extensive with one one another the beams constituting a platform for a roofer;

a second support adjacent one end of the second beams and having a roof section and a platform section, the roof section being adapted to engage a roof for mounting the staging thereon and the platform section being fixedly connected to and supporting said second beams;

said first and second beams being telescoped together and the respective beams and their supports being longitudinally slidable relative to oen another as between a closed position and an open position, in the closed position the respective beams forming a unitary pack for a roofer to carry up a ladder and deposit on a roof, the length of the pack being substantially less than the length so the staging in the open position and in the open position the beams being longitudinally spaced whereby one platform is an extension of the other and an expanded staging is formed; first means disposed adjacent the opposite end of said first beams and operatively, slidably connected between the first and second beams and maintaining the beams in telescoped condition;

second means disposed adjacent the opposite end of said second beams and operatively, slidably connected between the first and second beams and maintaining the beams in telescoped condition;

an intermediate support disposed between said first and second means, the support having a roof section and a platform section, the roof section being adapted to engage a roof for mounting the staging thereon and the platform section supporting and having a sliding engagement with said first and second beams;

the intermediate support also having keeper means fixed to the support and having a sliding engagement with said first and second beams; and the keeper means and the platform section holding the intermediate support and beams together and providing for the intermediate support and the beams to be relatively longitudinally slidable whereby when either one of said first or second supports and its beams are fixed to the roof and the other support and its beams are not fixed to the roof, said other support and beams can be moved as between said closed and open positions.

10. The staging of claim 9 further including outrigger means connected to said intermediate support and extending in said longitudinal direction outwardly from opposite sides of said intermediate support and having sliding contact with at least one of said beams to prevent the support form cocking during said longitudinal relative motion.

11. The staging of claim 10 wherein said outrigger means comprises a pair of arms each connected to said intermediate support and respectively extending outwardly from opposite sides of said intermediate support on opposite sides of one of said beams and having a sliding engagement therewith.

12. The staging of claim 9 wherein said first and second means each comprise a pair of C-shaped members respectively disposed on opposite sides of the beams and each being fixedly connected to one of the first or second beams and having a sliding engagement with the other second or first beams.

13. The staging of claim 1 wherein the roof section of each support is provided with three keyholes slots, each slot extending axially along the roof section and oriented with its enlarged section directed toward the platform section and three slots being disposed with one in the center of the roof section and the other two on opposite sides of the center; and said components of the staging being dimensioned so that in the open position the distance between the center keyhole slot on the first and second supports is substantially 96 inches and the respective distances between the center keyhole slot on the intermediate support and the center keyhole slots on the first and second supports are each substantially 48 inches.

* * * * *